United States Patent [19]

Katayama

[11] 4,065,933

[45] Jan. 3, 1978

[54] METHOD OF REFORMING THE GROUND

[75] Inventor: Ichiro Katayama, Nishinomiyashi, Japan

[73] Assignee: Takenaka Komuten Company, Ltd., Osaka, Japan

[21] Appl. No.: 728,138

[22] Filed: Sept. 30, 1976

[30] Foreign Application Priority Data

Feb. 2, 1976 Japan ..... 51-10108

[51] Int. Cl.[2] ..... E02D 3/12; E02D 27/02

[52] U.S. Cl. ..... 61/50; 61/36 R

[58] Field of Search ..... 61/35, 36, 50, 53.52, 61/53.64, 63

[56] References Cited

U.S. PATENT DOCUMENTS

| | | | |
|---|---|---|---|
| 753,008 | 2/1904 | Shuman | 61/53.64 |
| 3,908,387 | 9/1975 | Nakamura | 61/36 R |

FOREIGN PATENT DOCUMENTS

| | | | |
|---|---|---|---|
| 1,458,165 | 10/1966 | France | 61/35 |

*Primary Examiner*—Jacob Shapiro

[57] ABSTRACT

This invention relates to a method of forming a solid foundation in soft ground or stratum by mixing chemical agent into the soft ground soil to solidify it. This ground reforming method comprises the steps of driving a casing into the soft stratum to be reformed so that the casing encloses a volume of earth, moving the enclosed soil out of the casing, mixing and kneading the chemical hardener with the removed soil, then returning the mixed and kneaded soil into the casing, and finally pulling the casing up. The columnar piles thus formed of consolidated soil provide a solid foundation in the soft soil stratum, either independently or in combination. The columnar piles built up according to the method of this invention have uniform and high dynamic strength.

2 Claims, 7 Drawing Figures

METHOD OF REFORMING THE GROUND

BACKGROUND OF THE INVENTION

This invention relates to a method of reforming soft ground, accumulated sludge layer and the like to provide a solid foundation therein.

Great difficulties are encountered when reclaiming land from the sea or building a bank or other structures on a layer of soft soil accumulated on the seabed or on land. For instance, the soft soil layer on the seabed is, in most cases, unable to sustain the load of the structure or earth laid thereon because unconfined compression strength of such soil is usually as low as around 0.1 $Kg/cm^2$.

Therefore, in order to make such land reclamation or build a structure on soft ground, it is necessary to strengthen the ground by performing a consolidation treatment on the soft soil layer or by other means.

Among the conventional methods for the purposes mentioned above are the followings;

1. Displacement method in which the soft soil is replaced with sand,
2. Method in which sand piles or drains are constructed the soft ground to increase the degree of consolidation of soil,
3. Sand compaction method.

The aforementioned three are physical reforming methods and another is chemical one.

4. Chemical reforming methods in which earth is consolidated by using quicklime or liquid chemicals.

Any of these known methods, however, was unsatisfactory in some respects. For example, the above method (1) requires a vast volume of sand or soil to be wasted and then involves the difficult problem of disposal of the removed soft soil, while the methods (2) and (3), in addition to the above mentioned problem, require a long term of works and also their effect is uncertain. These methods (2) and (3) have the tendency of settlement of the reclaimed land or structures built on the reformed ground after the work.

According to the method (4), the soft soil is agitated with the chemical hardener by an agitator to mix and knead them up. This method is divided into two types, one in which the soft soil is treated in its entirety at the site, while the other in which it is treated portionwise by a unit volume of soil at one time. The former type requires much time and labor and hence is expensive. Also, the soft soil is treated at the site (in the accumulated form) in said both types of method, then it is difficult to obtain the reformed ground with uniform strength, because the soft layer such as the sludge layer formed as a result of long-year accumulation of various kinds of substances may include the layer or layers of hardly solidifiable soil such as corroded soil, and also because the various layers may not be constant in water content. It is, moreover, difficult to examine and confirm the existence of such layers and water contents thereof prior to the work. For these reasons, it was hardly possible to obtain solid ground with uniform strength through these conventional methods and to design the structural foundation by utilizing the treated ground as solid foundation for buildings. Also, in case that the soft ground partly includes a hardly solidifiable soil layer or layers, there arise the problems of settlement, heaving or landslide to be unable to expect desired effects of reformation. Further, these conventional methods include the problems of low efficiency of agitation or a lot of consumption of the chemical hardener.

SUMMARY OF THE INVENTION

The present invention has been developed to eliminate aforementioned drawbacks of the conventional methods using chemical hardener and thereby to provide a novel land reforming method.

According to the method of this invention, a casing is driven into the soft ground to be treated so as to enclose a definite volume of soft soil within the casing, then such definite volume of soil is removed out of the casing and powdery chemical hardener is mixed into and kneaded with the soil. The soil thus treated is then returned into the casing, and thereafter the casing is pulled up. As a result of it, a columnar pile of consolidated soil is formed independently or in continuation in the ground. As described, the ground reforming method of this invention is capable of forming columns of compact soil having uniform dynamic strength by using soft soil existing at the site for the purposes of economization of natural resources and elimination of pollution.

BRIEF DESCRIPTION OF THE DRAWINGS

The appended drawings illustrates embodiments according the present invention.

DETAILED DESCRIPTION OF THE EMBODIMENT

An embodiment of the present invention will be discribed hereafter in detail with reference to the accompanying drawings.

Figure 1:
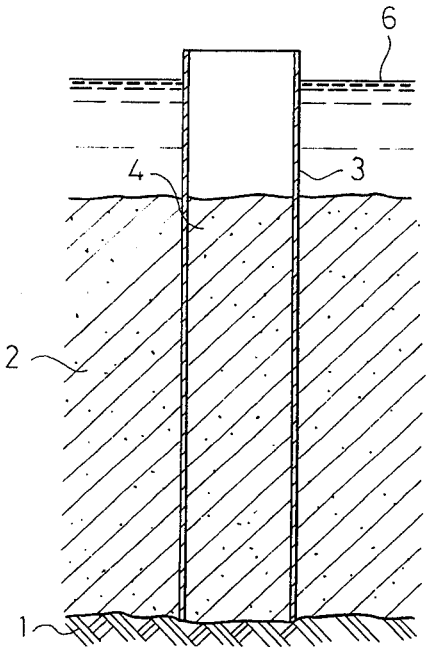
FIGS. 1 and 2 are longitudinal sectional views showing a condition with a casing driven into the soft ground and a formed columnar pile of solidified soil, respectively.
Figure 2:
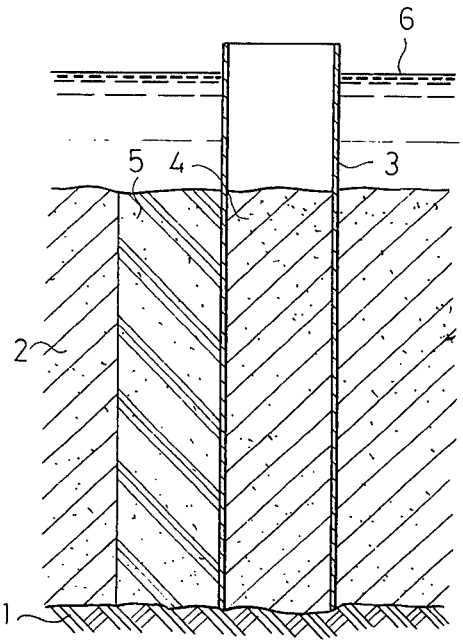

In case that the treatment is to be performed on the layer of soft soil 2 accumulated on the seabed 1, as shown in FIGS. 1 and 2, a hollow casing 3 with circular or polygonal cross-section is driven into soft soil layer 2 to a substantial depth or as far as reaching the bed 1, so that the casing encloses a definite volume of soft soil 4 in isolation from the surrounding soft soil layer. Thereafter, this definite volume of soft soil 4 is taken out of the casing by a suitable method and contained in a mixer or the like to agitate it therein. Then powdery chemical hardener is supplied to the mixer in an amount corresponding to water content of the soft soil, and both are mixed and kneaded. During this operation, the casing is kept set in the soft soil layer 2.

When the soft soil and the chemical hardener have been mixed and kneaded to a satisfactory degree, the treated soil is returned into the casing 3. The soil beings to solidify in the casing 3, and at a proper time before the soil is completely solidified, the casing is drawn out with a suitable means. In this way, a columnar pile 5 of the definite volume of the consolidated soil is built up in the soft soil layer 2 (see FIG. 2).

In case that sea water 6 exists above the soft soil layer as shown in FIGS. 1 and 2, the casing 3 is set so as to project its upper end above water surface, and in some cases, suitable means are provided to prevent entrance of sea water into the casing, and then the above mentioned steps are followed to build up the columnar pile.

The columnar pile 5 may be formed singly or in continuation. In the latter case, a single casing or two or more casings may be used in combination.

Figure 3:
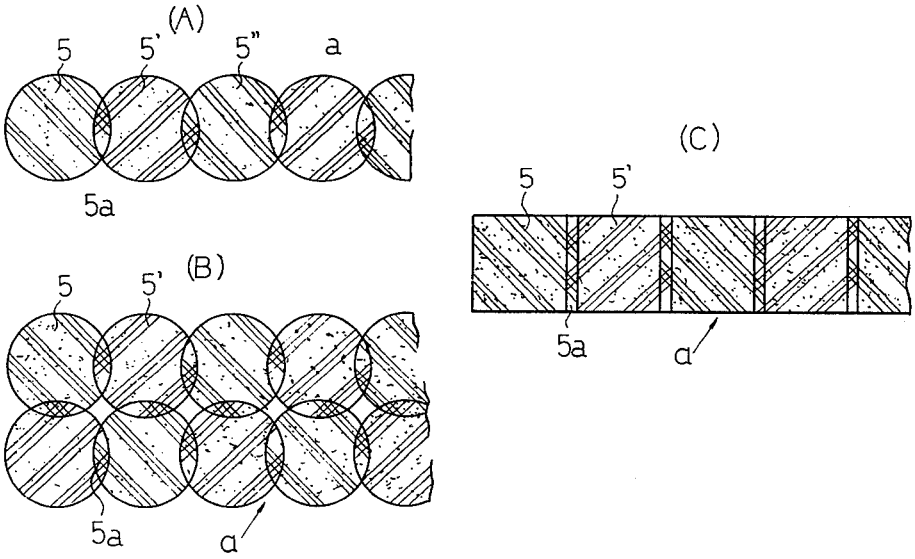
FIGS. 3 (A), (B) and (C) are plane views showing different patterns of arrangement of the columnar piles.

In case of using a single casing, the above mentioned process is carried out repeatedly so that the pre-constructed columnar pile 5 and the succeeding columnar pile 5' will overlap each other shown by 5*a*. In case of using two or more casings, the casings may be first driven into the ground to be reformed at predetermined intervals so as to build a desired number of columnar piles in succession, and then after removing said casing, the same casings are again driven into between preceding columnar piles to form the similar columnar piles in the same way overlapping the corresponding preceding columnar piles, thereby to form a continuous structure *a* in the soft soil layer to a desired pattern as shown in FIG. 3 (A), (B) and (C).

Now the apparatus used for practicing the method of this invention is described through an example.

Figure 4:
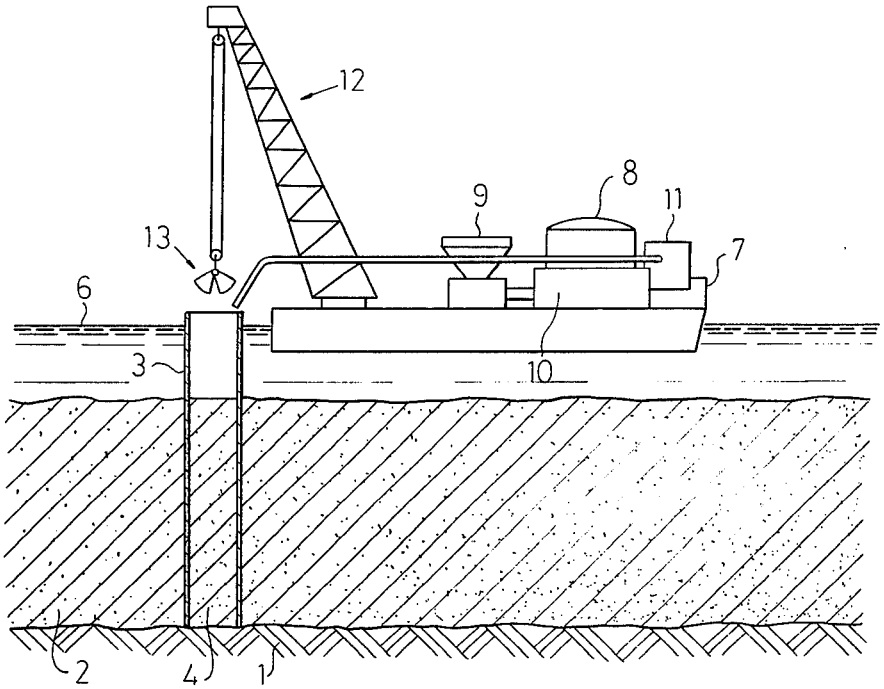
FIG. 4 is a side view with a partly longitudinal section, illustrating a mode of treatment of soft ground with being a working barge.
Figure 5:
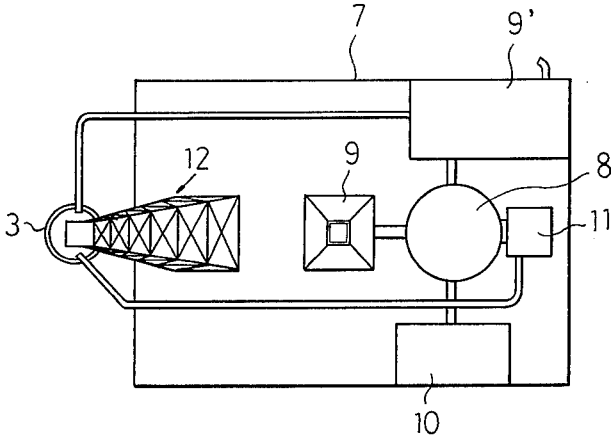
FIG. 5 is a top plan view of the working barge used for performing the method of this invention.

As shown in FIGS. 4 and 5, there is used working barge 7 which is self-powered or towed by a suitable drive means and which mounts thereon a mixer 8, whereby the soft soil and the chemical hardener are mixed and kneaded by agitation, a hopper 9 containing the soft soil, a chemical hardener feeder 10 and a pump 11 for feeding the treated soil (mixed and kneaded with the chemical hardener) back into the casing. Said devices 9, 10 and 11 are also connected to the mixer 8 by piping. There are also provided on the working barge 7 a device 12 for hoisting the casing, a device 13 for removing the soft soil out of the casing, said device comprising an auger, glove, pump or like means, means (not shown) for driving the casing into the soft ground by way of vibration or swinging motion, and means (not shown) for drawing out the casing.

In case that the device 13 to remove the soft soil is formed from a pump, it needs to mix water into the soft soil in the casing to make the soil into liquid mud suitable for the pumping operation, so that a separator tank 9' is provided in place of the hopper 9 or in connection to the hopper via a pipe as well as to the mixer 8 via a pipe, whereby the soft soil with reduced water content is supplied to the mixer. This allows effecient mixing and kneading treatment by use of the chemical hardener.

Thus, according to the method of this invention, removal of the soft soil as well as agitation, mixing and kneading of the soft soil with the chemical hardener can be performed at the very site of treatment, so that removal of the soft soil and its return to the casings can be accomplished very efficiently and also there is no fear of offensive smell production over a wide area.

Also, since the soft soil is agitated and treated in a mixer after removed out of the casing, very effective use of the chemical hardener and then economical consolidation treatment are realized.

As described above, according to the method of this invention, the definite volume of the soft soil enclosed and separated from the surrounding layer of the soft soil by the casing is removed out of the casing, then agitated with the chemical hardener in a mixer to be well mixed and kneaded and thereafter brought back into the casing again to build up a structure of consolidated soil piles, so that even if the soft stratum is composed of layers of various kinds of accumulated materials, or differs in water content from layer to layer according to the depth, mixing and kneading of the soil with the chemical hardener can be attained uniformly to give the desired reformation of the ground with uniform dynamic strength. It is to be also noted that the columnar piles of consolidated soil formed in the soft ground according to this invention have particularly high resistance against sliding failure. Further, since the process of removal, agitation and return to the casing of the soft soil are carried out by treating a relatively small definite volume of soil at one time, such consolidation treatment can be accomplished with high efficiency and without causing any environmental pollution at the site of accumulation of the soft soil by using the proper working barge. Moreover, since the soft soil itself in the soft ground is used as material for forming the reforming columnar piles, the invention conduces greatly to economization of natural resources.

As the columnar piles obtained according to the method of this invention have uniform strength as described above, they provide solid base or support for building various kinds of structures thereon so that this invention contributes greatly to civil engineering and construction industries.

What is claimed is:

1. A method of reforming soft ground or stratum under water with a chemical hardener, said method comprising the steps of:

driving at least one casing into the soft soil layer under the water to enclose and isolate a definite volume of the soft soil from the surrounding soft soil layer;

removing the definite volume of the soft soil from the casing using a removing device mounted on a working barge above the casing, and placing the removed soil in a hopper on the barge;

feeding the soft soil from the hopper and the chemical hardener from a feeder mounted on the barge into a mixer mounted on the barge;

kneading the soft soil together with the chemical hardener in the mixer;

returning the treated soil into the casing with a pump mounted on the barge; and removing the casing, leaving a submerged pile of hardened soil.

2. The method as claimed in 1, wherein:

said driving step includes driving a plurality of spaced apart casings;

said step of removing the volume includes removing the soil from each of the casings; and said step of removing the casings includes removing each of the casings after forming a plurality of spaced piles; and further comprising the step of driving the casings into the soft soil between the piles and repeating said steps of removing the volume, feeding, kneeding, returning, and removing the casings, thereby forming a continuous solidified area in the soft soil layer.

* * * * *